US005416677A

United States Patent [19]

Stanuch

[11] Patent Number: 5,416,677

[45] Date of Patent: May 16, 1995

[54] WARNING LIGHT SOCKET ASSEMBLY AND METHOD FOR INSTALLING SAME

[75] Inventor: Edward J. Stanuch, Frankfurt, Ill.

[73] Assignee: Federal Signal Corporation, University Park, Ill.

[21] Appl. No.: 139,243

[22] Filed: Oct. 19, 1993

[51] Int. Cl.[6] ..... H01R 33/00

[52] U.S. Cl. ..... 362/226; 362/83.3; 362/216; 362/263; 362/390; 313/318.01

[58] Field of Search ..... 313/318; 362/95, 147, 362/216, 221, 222, 226, 263, 265, 267, 366, 369, 390, 61, 80, 83.3

[56] References Cited

U.S. PATENT DOCUMENTS

| | | | |
|---|---|---|---|
| 1,450,079 | 3/1923 | Hawthorne . | |
| 1,807,140 | 5/1931 | Von Wedel | 362/216 |
| 1,886,326 | 11/1932 | Cadieux . | |
| 1,950,445 | 3/1934 | Braselton | 362/216 |
| 2,503,677 | 4/1950 | McHenry et al. . | |
| 2,645,736 | 7/1953 | Dickson | 313/318 |
| 2,860,233 | 11/1958 | Johnson, Jr. | 362/390 |
| 3,444,364 | 5/1969 | Taylor et al. | 362/226 |
| 3,999,095 | 12/1976 | Pearce, Jr. et al. | 313/318 |
| 4,360,861 | 11/1982 | Fitzgerald | 362/390 |
| 4,391,766 | 7/1983 | Bernard et al. | 362/263 |
| 4,547,838 | 10/1985 | Wakimizu | 362/211 |
| 4,569,005 | 2/1986 | Bergin et al. | 362/267 |
| 4,771,369 | 9/1988 | Hymer | 362/80 |
| 4,819,133 | 4/1989 | Kochi et al. | 313/318 |

FOREIGN PATENT DOCUMENTS

| | | | |
|---|---|---|---|
| 772022 | 11/1967 | Canada | 362/216 |

*Primary Examiner*—Ira S. Lazarus
*Assistant Examiner*—Alan B. Cariaso
*Attorney, Agent, or Firm*—Leydig, Voit & Mayer, Ltd.

[57] ABSTRACT

An improved socket assembly for a warning light includes a frustro-conical base and a lamp extending from the top of the base. The base contains electrical components for operation of the lamp and provides electrical connection from the bottom of the base. At least one annular recess is formed in the side of the base at a selected distance from the lamp. Inasmuch as the base is fabricated of a compressible material, it may be radially inwardly compressed to mate the recess with an opening formed within a lamp housing.

22 Claims, 3 Drawing Sheets

WARNING LIGHT SOCKET ASSEMBLY AND METHOD FOR INSTALLING SAME

FIELD OF THE INVENTION

The present invention relates generally to the warning light art. More particularly, the present invention pertains to the art and science of providing warning lighting for safety vehicles and the like, such as for police or fire department vehicles. Even more specifically, the present invention provides a socket assembly for a warning light and a method of installing that socket assembly to increase installation efficiencies, including eliminating the need for multiple components, while reducing cost and safety risks associated with prior designs.

BACKGROUND OF THE INVENTION

A variety of warning lighting configurations and systems have been developed for use in conjunction with safety vehicles or the like. Typically such vehicles include a primary warning light system, and secondary warning light units that are used in conjunction with the primary system. Because these warning lights often are designed to meet certain photometric and flash rate requirements, they must be capable of substantial amounts of flash energy over prolonged periods of time.

Heretofore, socket devices for warning lights, particularly those used for retrofitting existing lamp housings in secondary warning systems for a safety vehicle, have included a rigid socket body comprised of various interfitting pieces. One such socket device includes complemental pieces that form a bayonet-type housing. One of the pieces is glued or otherwise secured to an opening formed in a lamp housing. In other instances, such pieces are fit within grommeting or other sealant materials surrounding the opening. The complemental piece of the socket device is then inserted into the secured piece to couple the retrofitted light into the lamp housing. While such devices give adequate performance, they are somewhat difficult to install and require significant man hours to engage the socket pieces together and perfectly align the retrofitted lamp near the focal point of the lamp housing. In addition, since these devices are relatively inflexible, they are susceptible to vibration and wear, particularly over prolonged periods of time.

SUMMARY OF THE INVENTION

Thus, the prior art socket designs, particularly for warning lights in safety vehicles, now offer unsatisfactory performance, at relatively high cost. Accordingly, a principle object of the present invention is to generally overcome deficiencies of the prior art.

More particularly, it is an object of the present invention to provide a socket assembly which is easily installed, yet reliable in operation.

It is another object of the present invention to provide a socket assembly that is readily adaptable to be received in multiple configurations.

It is still another object of the present invention to provide a socket assembly that provides improved electrical insulation as well as shock absorption for a warning light or other electrical components.

The present invention provides these and other additional objects through an improved socket assembly for a warning light, such as a strobe tube used in a safety vehicle. The present invention further provides a method for installing the same invention to achieve the desired result. Structurally, a preferred embodiment of the present invention comprises a generally frustroconical-shaped socket body fabricated of a elastically deformable material with a top, bottom, and tapered side surfaces. A warning light is potted within, and extends from the top of, the socket body. The socket body preferably houses electrical circuit components for operating the lamp. The socket body further includes one or more annular recesses spaced from the center-light of the warning light at a selected distance. Each recess is of a size and dimension to be received by a selected opening located in a lamp housing. The diameter of the opening and the diameter of a selected one of the annular recess are approximately matched so that the assembly may be seated within the opening by insertion. In this fashion, the center-light of the warning light may be registered at or near the focal point of the light housing. Preferably, the socket body includes more than one annular recess so that the assembly may be easily inserted into several different lamp housings having varying focal points, while maintaining registry of the warning light proximate to the housing focal point. The conical shape and the radial compressibility of the socket body provides easy insertion of the assembly proximate to the focus of the light housing.

One or more of these socket assemblies may be easily installed in an existing light housing of a safety vehicle. This may be achieved by first locating a position at or near the focal point of the existing lamp housing. An opening having a selected diameter is thereafter provided at that location. The diameter of the opening is slightly larger than the annular recess of the socket body that is spaced from the center-light at a distance corresponding to the distance between the lamp housing and its focal point, yet larger than at least a portion of the body. The socket assembly is then longitudinally inserted within the lamp housing opening until the recess is aligned with the annular opening. In this way, the socket body automatically positions the warning light at a location close to the focal point of the lamp housing. Thereafter, the electrical wiring of the unit is coupled with a power supply unit or other appropriate electronics. Additional socket assemblies may alternatively be then mounted within other openings formed in other lamp housings. This may be done in the same manner as described above. When correctly positioned within the lamp housing, there is a collimation of light emitted by the warning lamp at or near the focal point of the lamp housing. Additional features and embodiments are described below.

DETAILED DESCRIPTION OF THE DRAWINGS

The above described an additional objects and features of the present invention may be further understood by reference to the following detailed description of the preferred embodiment taken into conjunction with the accompanying drawings of which:

It will be understood that the drawings are not necessarily to scale. In certain instances, various details may have been omitted which are not necessary for an understanding of the present invention.

DETAILED DESCRIPTION OF THE PREFERRED EMBODIMENT

Generally, the present invention provides an improved socket assembly for a warning light used in a safety vehicle. The socket assembly includes an elastically deformable frustroconical base structure with a top, bottom and tapered side and a lamp extending from the top of the base. At least one annular recess is formed around the periphery of the side and sized for reception within an opening formed in a reflector housing. Inasmuch as the base is fabricated of a compressible material, it may be radially inwardly compressed for longitudinal insertion within the opening until the annular recess is seated within the opening. In accordance with the present invention, the recess is spaced from the lamp at a selected distance so that, upon insertion of the socket assembly, the lamp is located at or near the focal point of the reflector housing.

One of the intended uses this socket assembly is for installation in dedicated warning systems. In addition, the socket assembly may also be easily retrofitted into existing light assemblies in safety vehicles. The invention, however, is not limited to such applications as one skilled in the art will appreciate, particularly after considering the teachings herein.

Figure 1:
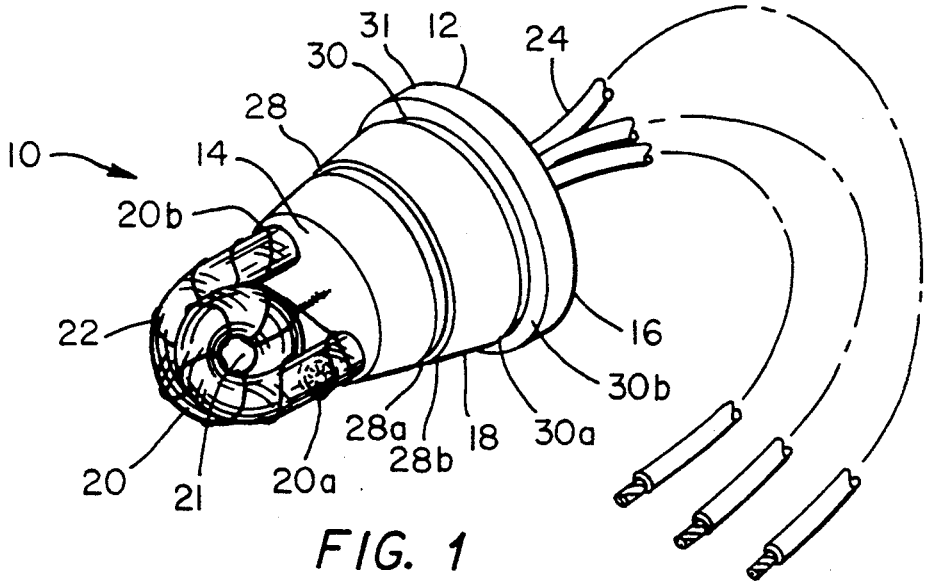
FIG. 1 is a perspective view of the socket assembly of the present invention according to the preferred embodiment.

Referring now to FIG. 1, therein is shown a perspective view of a socket assembly 10 according to the present invention. The main structural details of the assembly 10 include a socket body or base portion 12. The base 12 is preferably a unitary, generally frustro-conical structure that includes reduced diameter portions that are designed to be seated within an opening formed in a lamp housing, as described below. The base 12 is defined by a generally circular top surface 14, an opposed generally circular bottom surface 16 substantially parallel to the top surface, and a generally tapered side surface 18. The radial dimension of the top surface 14 is smaller than that of the bottom surface 16, as is shown in FIG. 1. In the preferred embodiment, the base portion 12 is a molded, elastically deformable material. Most preferably, the base portion 12 is an elastomeric material such as RTV11-S, a silicon compound manufactured by General Electric Co. The base 12 may be fabricated of other suitable materials that are sufficiently pliable to permit the base 12 to be radially inwardly compressed while being inserted longitudinally within an opening, while substantially assuming its original configuration when the compressive forces are removed.

In the preferred embodiment, the socket assembly 10 includes a strobe tube 20 that is embedded in and has a portion that protrudes from the socket body 12. The strobe tube 20 comprises a pyrex tube potted within the socket body 12 that is generally helical in shape, and houses an anode 20*a* and a cathode 20*b* extending from the top surface 14 of the socket body 12. A center-light denoted by the line 21 is defined for the strobe tube 20 at a location substantial near the center of the helical portions of the tube 20. It is desirable to locate the center-light at or close to the focal point of the reflector housing in which the socket assembly is seated, as described in greater detail below. A conductive wire mesh 22 is wrapped around the strobe tube 20 for ionizing the gas contained within the strobe tube 20 during operation, as will be understood by those skilled in the art to which this invention pertains. The socket assembly 10 also includes wiring 24 or other suitable electrical connection means extending from the bottom 16 coupled with a power unit 26 (see FIGS. 4 and 5), which will likewise be understood by those skilled in the art.

Figure 2:
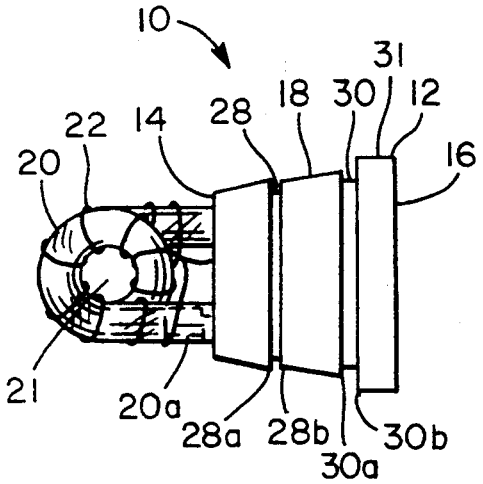
FIG. 2 is a side elevational view of a socket assembly of FIG. 1.
Figure 3:
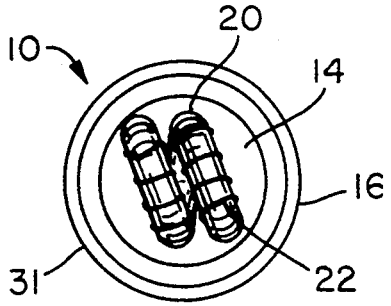
FIG. 3 is a top view of the socket assembly of FIG. 1.

FIG. 1 and FIG. 2 also illustrate reduced diameter side portions formed in the socket body shown as longitudinally spaced annular channels or recesses 28 and 30 formed around the periphery of the side surface 18. The recesses 28 and 30 each have a selected diameter and are each spaced in parallel relation at a selected distance from the center-light of the strobe tube 20. In this way, the socket body positions the center-light at a desired depth or near the focal point of a lamp housing when an opening is formed in the housing to correspond with one of the recesses. Thus, for example, the recess 28 has a diameter of approximately 0.91 inches and is spaced approximately 0.88 inches from the center-light of the tube 20. Recess 30 has a diameter of approximately one inch and is spaced approximately 1.25 inches from the center-light of the strobe tube 20. While such dimensions have been found to produce the best results for the applications described hereinafter, those skilled in the art to which this invention pertains will appreciate that other spacings between the center light of the strobe tube 20 and the socket recess may work just as well in other applications.

Figure 8:
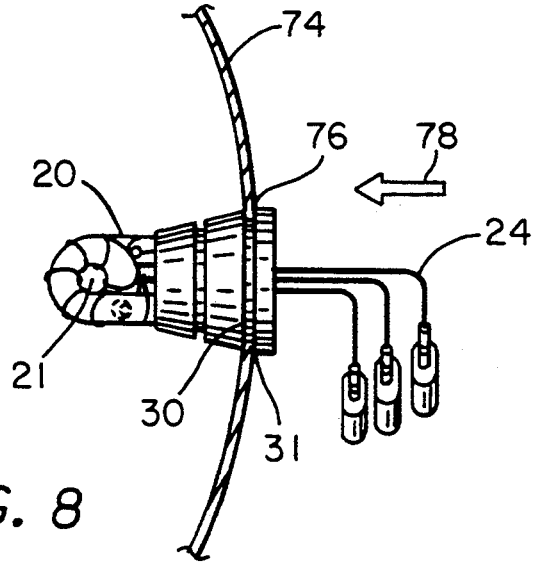
FIG. 8 is a fragmentary elevational view of FIG. 7.

The socket body 12 also includes opposed outer lips 28*a*, 28*b* and 30*a*, 30*b* corresponding with the recesses 28 and 30, respectively. When the socket body is seated within a receiving opening so that one of the recesses is aligned therewith (see FIGS. 6 and 8), the opposed lips protrude slightly beyond the opening. This arrangement seals the strobe tube 20 within the lamp housing while maintaining the strobe tube 20 at a desired depth. As shown in FIGS. 1–4, and 8, the socket body 12 includes a collar 31 that joins outer lip 30*b* and is disposed in close relation to the annular recess 30. As best seen in FIG. 8, the collar 31 overlaps a portion of reflector housing 74 when the socket body is inserted into an opening 76 of the reflector housing 76.

Figure 4:
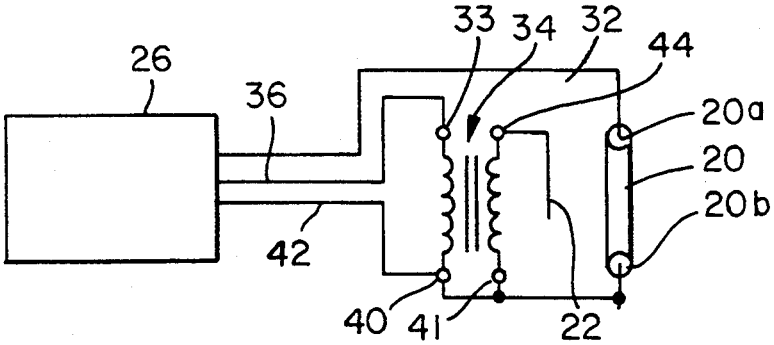
FIG. 4 is a simplified electrical schematic representation of the electrical components contained within the socket assembly.

Electronic circuit components used for operating the strobe tube 20 are also potted within the socket body 12. The strobe tube 20 preferably has its anode 20*a* coupled on a line 32 to a positive voltage source provided by the power unit 26, as seen in FIG. 4. A first terminal 33 of the primary winding of a trigger transformer 34 is coupled via a line 36 to a trigger voltage source provided by the power unit 26. The cathode 20*b* of strobe tube 20, the second terminal 40 of the primary winding and one terminal 41 of the secondary of transformer 34 are connected, via a line 42 to ground. The other terminal 44 of the secondary winding is coupled with the wire mesh 22.

The socket assembly 10 is preferably assembled with the use of a two-piece cavity mold using a process that will be understood by those skilled in the art. First, the appropriate electrical connections are made between the strobe tube 20, the terminals of the trigger transformer 34, the wire mesh and the electrical wiring 24, as described above. Then these components are placed within one of the cavity mold pieces and held in place. Thereafter, the pieces of the mold are closed together, and the base material is poured through a dispenser into the mold while the base material is in a liquid state. The base material is then cured approximately 15 hours to provide a monolithic socket body that is a substantially solid mass, while being somewhat elastically deformable.

In order to generate a flash, a positive voltage (approximately 300 Vdc) is applied between the anode and the cathode of the strobe tube 20. A positive trigger voltage is then applied to the first terminal 32 of the primary winding of trigger transformer 34. A potential likewise appears between the wire mesh 22 and ground to ionize the gases contained within the strobe tube. Inasmuch as the resistivity of the gases decreases when ionization occurs, current flows between the anode and the cathode to cause the gas to glow and initiate a flash for as long as the gas is ionized. When the trigger voltage is removed, the gases within the tube return to a lower energy state and current is prohibited from flowing therethrough. Typically, the strobe tube has a flash-rate of 90 f.p.m. in operation.

One of the advantages of the socket assembly according to the present invention is the improved electrical insulation for the electrical components contained within the socket body 10. Inasmuch as the socket body is a continuous mass fabricated of an elastomeric material in which the electrical components are embedded, the occurrences of electrical short circuits are greatly reduced. On the other hand, the bayonette-type socket assemblies of the prior art are susceptible to developing short circuits over periods of time for, among other reasons, the movement of various interlocking housing parts.

In addition, the invention provides shock mounting provided by the socket body 12. The pliable nature of the socket body 12 retains the flash tube 20 and other electrical components in place, while at the same time, provides adequate shock absorption to prevent dislodgement or breakage of the flash tube and other components due to vibration or other forces applied to the assembly. This is particularly beneficial in warning lighting designs, which typically operate at relatively high power in order to provide desired intensity.

Figure 5:
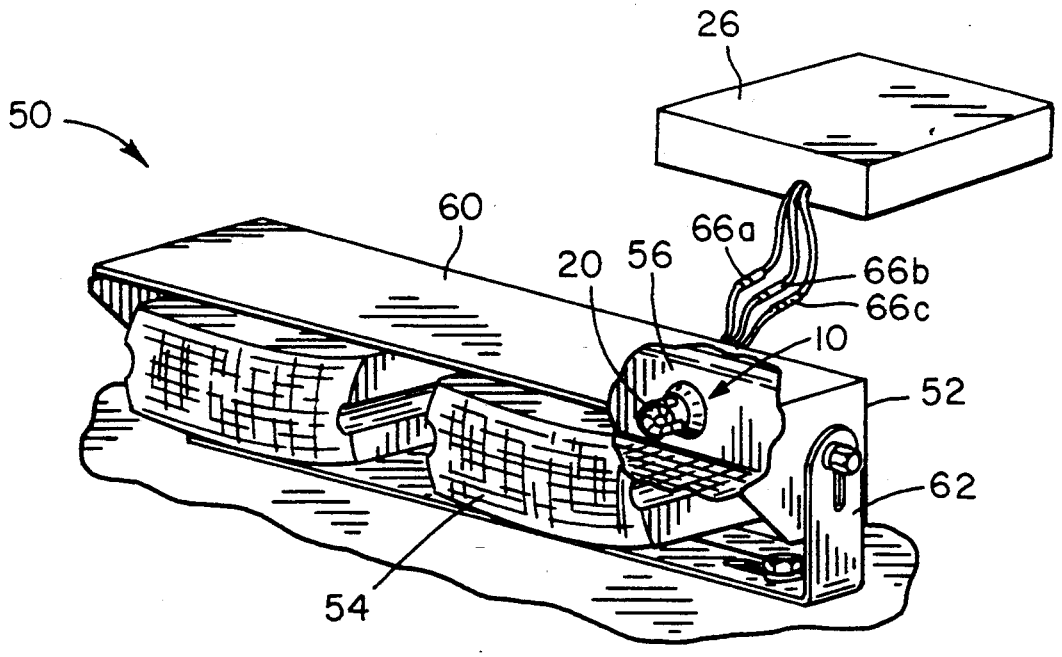
FIG. 5 is a perspective view of a light assembly showing the socket assembly of FIG. 1 in conjunction with a first type of lamp housing when used in a first mode.

Referring now to FIG. 5, therein is shown an exploded perspective view of a light assembly 50, including the socket assembly 10 inserted within a light housing 52 according to one application of the present invention. In this instance, the light housing 52 includes a lens covering 54 that is secured to a mounting plate 56 via retaining screws or other suitable retaining means. The light housing 52 also includes a top cover 60 mounted to bracket piece 62 for securement to the rear deck of a safety vehicle or at other suitable locations, preferably within the interior of the vehicle. An appropriate mounting position for the assembly is determined so that the assembly may be mounted in a horizontal position, for maximum coverage and effectiveness of the warning light.

The configuration of the mounting plate 62 provides the greatest collimation of light emitted by the strobe tube 20 when the center-light of strobe tube 20 is spaced inwardly from the back plate 56 approximately 0.88 inches. For this reason, an opening 64 is provided in the plate 56 to receive the socket body 12 via longitudinal insertion of the socket body into the opening 64 in the direction of arrow 65. The opening 64 has a diameter slightly larger than the diameter of the socket body recess 28, but less than the diameter of the outer lips **28*a* and 28*b* corresponding with recess 28**.

Figure 6:
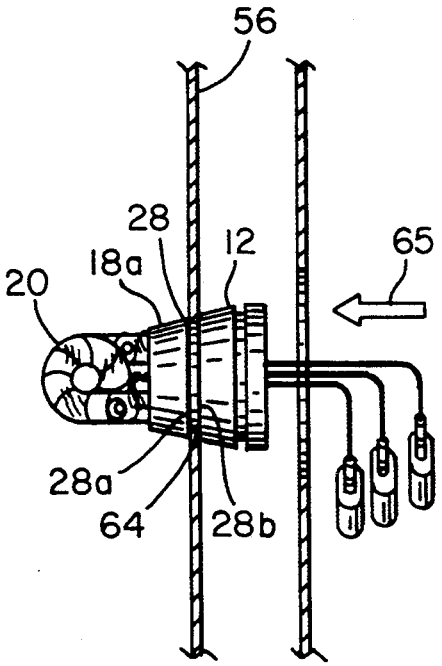
FIG. 6 is a fragmentary elevational view of the light assembly of FIG. 5.

The installation of the socket assembly 10 within the light housing 52 shown in FIGS. 5 and 6 is relatively straightforward. The socket assembly 10 is longitudinally inserted into the opening 64 until the recess 28 is aligned with the opening, as denoted by arrow 65 shown in FIG. 6. A portion **18*a* of the side surface 18** must be at least somewhat radially inwardly compressed while the socket body is inserted.

In order to replace the socket assembly 10, power is first removed from the system. The lens covering 54 is next removed by removal of the retaining screws. Next, the top cover 60 is removed from the mounting plate 62. In a next step, the terminals **66*a–c* from the socket assembly 10 are disconnected from the power unit 26. Thereafter, the socket assembly 10 may be manually removed from the mounting plate 62 by pulling the wires rearwardly at the base of the assembly which, in turn, removes the socket assembly from the mounting plate 62. A new socket assembly 10 is thereafter inserted into the mounting plate opening 64 until the recess 28 of the socket body is aligned with the opening 64 as described above. In certain instances, it may be desirable to apply a high temperature grease, or the like, to the side portion 18*a*, as shown in FIG. 6, to facilitate insertion of the socket body 12**. The terminals are thereafter reconnected and the unit is reassembled.

Figure 7:
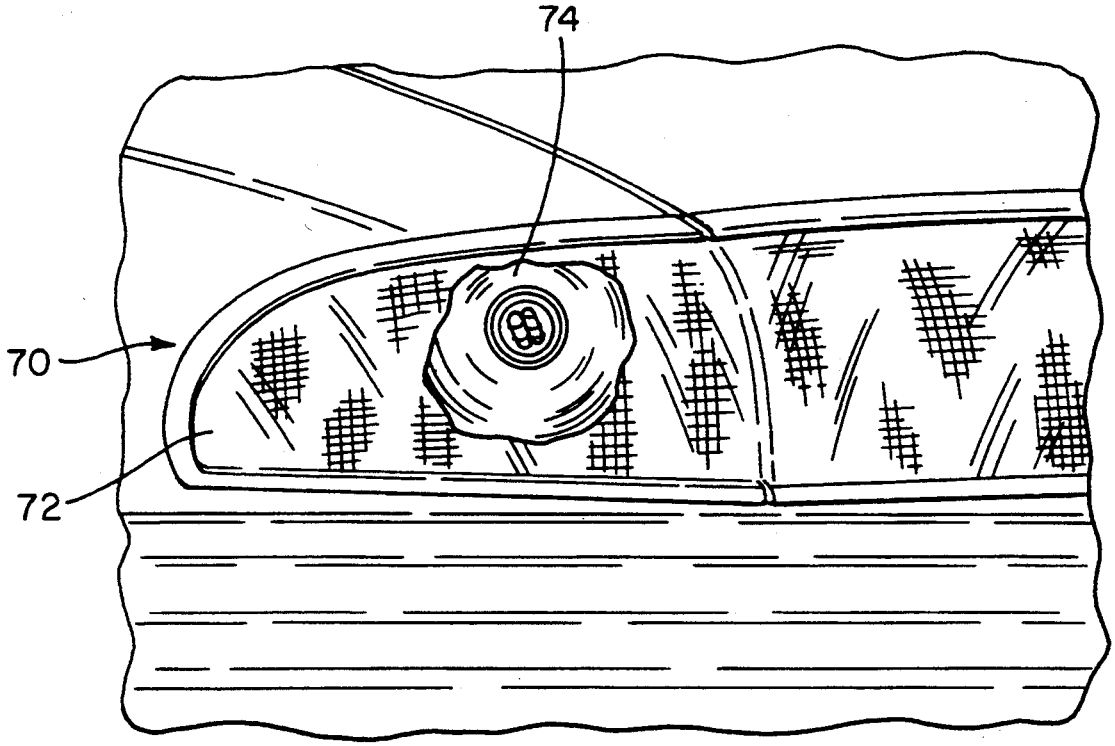
FIG. 7 is a perspective view of an alternative light assembly illustrating the socket assembly of FIG. 1 placed within a different lamp housing in a second mode.

Turning now to FIGS. 7 and 8, therein is shown an exploded perspective view of a second application for the socket assembly 10. In this application, the socket assembly 10 is designed for retrofitting within a corner light assembly 70 of a safety vehicle. The corner light assembly 70 includes a lens 72 removably connected with a reflector housing 74. The reflector housing 74 collimates light at a focal point spaced from the reflector housing surface. Other lighting units are typically also contained in the light assembly 10 as would be understood by those skilled in the art. As shown in FIGS. 7 and 8, an opening 76 is formed in the reflector housing 74, preferably at a location which is relatively flat and as close to the focal point of the reflector housing 74 as possible without interfering with other lighting units installed in the housing 74. When installed, the socket assembly 10 provides a full flash pattern on the reflector housing lens 72.

As shown in FIG. 8, the center-light 21 of the strobe tube 20 is spaced inwardly from the reflector housing wall 74, preferably it located approximately 1.25 inches from the reflector housing wall 74. Accordingly, the recess 30 is utilized to mate the socket assembly with the opening formed in the reflector housing wall.

In order to install the socket assembly 10 within the light assembly 70 shown in FIGS. 7 and 8, the reflector lens 72 and housing 74 are first removed from the vehicle. A suitable mounting location for the socket assembly 10 is then located on the reflector housing 74. In order to ensure a full flash pattern on the reflector lens, the mounting location is preferably in a flat surface and as close to the focal point of the reflector housing 74 as possible without interfering with other lamp units already installed within the housing. Next, an opening 76 of approximately one-inch in diameter is formed at the mounting location, which corresponds with recess 30 of the socket body 12. In a next step, the socket assembly 10 is slowly inserted in the reflector housing (in the direction of arrow 76) until it is seated in the recess 30 of the socket assembly, as shown in FIG. 8. At this location, the center-light of the strobe tube 20 protrudes from the reflector housing at or near the focal point of the housing. In some instances it is desirable to apply high temperature grease or vaseline into the edge of the strobe tube prior to insertion. Next, the electrical wiring 24 of the socket assembly 10 are coupled with the power unit. Thereafter, the lens 72 is secured to the housing. The replacement of the socket assembly is similar to that discussed above in conjunction with the embodiment shown in FIGS. 6 and 7.

The advantages of the disclosed socket design and the corresponding method of installation are readily apparent. For example, a dramatic decrease in the amount of time used to install the socket assembly is realized. That is, where prior designs may require the orientation and assembly of various interfitting pieces, the present invention provides a unitary socket body that easily mates with a corresponding opening in a lamp housing. Further, the socket design of the present invention provides improved electrical insulation as well as shock absorption for the warning lamp unit and corresponding electrical components contained within the socket. Likewise, the socket body a seal for the lamp, thus avoiding the need for separate grommeting around the lamp housing opening as required by prior designs.

As set forth above, an improved socket design and method of using the same has been described. Various modifications as would be apparent to one of ordinary skill in the art and familiar with the teachings of this application are deemed to be within the scope of this invention. The precise scope of the invention is set forth in the appended claims, which are made, by reference, a part of this disclosure.

Accordingly, both the structure and the method of installation of the present invention provides significant improvements over the prior art, improvements that are manifested both and reduced installation time and diminished cost in risk.

What is claimed is:

1. A lamp assembly for insertion within an opening of a selected radial dimension provided in a lamp housing comprising:

a generally frustro-conical socket body with a top surface having a radial dimension less than the selected radial dimension, a bottom surface having a greater radial dimension than the top surface and the selected radial dimension, and a generally tapered side surface including an annular recess formed therein sized for placement within the opening of the lamp housing, the side surface having a radially inwardly compressible section which elastically deforms substantially around the periphery of the side surface upon axial insertion of the socket body within the opening to permit mated engagement of the annular recess within the opening of the lamp housing;

a lamp unit with a first portion embedded in the socket body and a second portion extending from the top of the socket body a selected distance beyond the opening in the lamp housing; and electrical conductors embedded in the bottom of the socket body connecting the lamp unit with a power source.

2. The invention of claim 1 wherein the lamp unit is located proximate the focal point of the lamp housing.

3. The invention of claim 1 wherein the socket body includes a collar disposed in close relation to the annular recess and at least one lip opposed to the collar, the collar and the at least one lip overlapping at least a portion of the lamp housing when the recess is in mated engagement with the lamp housing opening to seal the interior of the lamp housing.

4. The invention of claim 1 further including lamp circuit means embedded within the socket body, the lamp circuit means being coupled with the electrical connection means and with the lamp unit for operating the lamp unit.

5. The invention of claim 4 wherein the lamp unit is a strobe tube.

6. The invention of claim 5 wherein the lamp circuit means includes transformer means for triggering the strobe tube.

7. The invention of claim 1 wherein the socket body is fabricated of a silicon compound.

8. A warning light assembly comprising:

a reflector housing having an opening with a first radial dimension formed near the focal point of the reflector housing;

a socket assembly including a generally frustro-conical base, a lamp unit, and electrical connection means for connecting the lamp unit with a power unit, the base including a top surface having a second radial dimension less than the first radial dimension with the lamp unit extending therefrom, a bottom surface having a third radial dimension greater than the first radial dimension with the electrical connection means extending therefrom, and a generally tapered side surface including at least one annular recess formed therein sized for mated engagement with the opening in the reflector housing, the base being a continuous mass that is radially inwardly compressible substantially around the periphery of a portion of the side surface when inserted longitudinally within the opening of the reflector housing to permit alignment of the annular recess with the opening and to locate the lamp unit proximate to the focal point of the reflector housing; and a lens covering the reflector housing and the lamp unit.

9. The invention of claim 8 wherein the base portion includes at least one lip disposed in close relation to the annular recess, the at least one lip protruding beyond at least a portion of the reflector housing when the recess is in mated engagement with the opening formed in the reflector housing to seal the interior of the lamp housing.

10. The invention of claim 8 further including lamp circuit means potted within the base portion coupled with the electrical connection means and with the lamp unit.

11. The invention of claim 10 wherein the lamp unit is a strobe tube.

12. The invention of claim 8 wherein the base portion is fabricated of a silicon compound.

13. A socket assembly operable in a first mode for insertion within a first opening provided in a lamp housing of a first type and operable in a second mode for insertion within a second opening formed in a lamp housing of a second type, the assembly comprising:

a molded socket body of a substantially continuous mass having a generally frustroconical-shape with a top surface, a bottom surface, and a generally tapered side surface, the side surface including a first annular recess formed therein and sized to be received by the first opening formed in the lamp housing of the first type and a second annular recess formed therein, spaced from the first annular recess and sized to be received by the second opening formed in the lamp housing of the second type, the side surface having a first radially inwardly compressible section which elastically deforms substantially around the periphery of the side surface to permit mated engagement of the first annular recess with the first opening in the first mode and a second radially inwardly compressible section which elastically deforms substantially around the periphery of the side surface to permit mated engagement of the second annular recess with the second opening in the second mode;

a lamp unit embedded in and extending from the top of the socket body; and electrical connection means embedded in and extending from the bottom of the socket body for connecting the lamp unit with a power source.

14. The invention of claim 13 wherein the lamp unit is located proximate the focal point of the first lamp housing when in the first mode.

15. The invention of claim 13 wherein the lamp unit is located proximate the focal point of the second lamp housing when in the second mode.

16. The invention of claim 13 wherein the socket body includes a pair of opposed outer lips disposed in close relation to the first annular recess, the outer lips protruding beyond at least a portion of the lamp housing of the first type when the first recess is in mated engagement with the lamp housing opening to seal the interior of the lamp housing.

17. The invention of claim 13 wherein the socket body includes a pair of opposed outer lips disposed in close relation to the second annular recess, the outer lips protruding beyond at least a portion of the lamp housing of the second type when the second recess is in mated engagement with the lamp housing opening to seal the interior of the lamp housing.

18. The invention of claim 13 further including lamp circuit means embedded within the socket body coupled with the electrical connection means and with the lamp unit.

19. The invention of claim 18 wherein the lamp unit is a strobe tube.

20. The invention of claim 19 wherein the lamp circuit means includes transformer means for triggering the strobe tube.

21. The invention of claim 13 wherein the base portion is fabricated of a silicon compound.

22. A method for installing a socket assembly within an opening provided in a lamp housing, the socket assembly including an elastically deformable socket body with a top surface, a bottom surface, and a generally tapered side surface with at least one reduced diameter portion formed therein, a lamp unit with a first portion embedded in the socket body and a second portion extending from the top surface of the base so as to protrude a selected distance from the reduced diameter portion, and electrical connection means extending from the bottom of the base for connecting the lamp unit with power source, the method comprising:

locating a position on the lamp housing proximate the focal point of said lamp housing;

providing an opening at said selected location with a radial dimension slightly greater than the radial dimension of the reduced diameter portion;

axially inserting the socket assembly within the opening until at least a portion of the socket body elastically deforms;

aligning the reduced diameter portion within the opening; and connecting the electrical connection means with the power source.

* * * * *